US006500262B1

(12) United States Patent
Bednarz et al.

(10) Patent No.: US 6,500,262 B1
(45) Date of Patent: Dec. 31, 2002

(54) REMOTE CONTROL DEVICE FOR PAINTING SYSTEM

(75) Inventors: Vincent L. Bednarz, Stow, OH (US); Jeffrey A. Perkins, Amherst, OH (US)

(73) Assignee: Nordson Corporation, Westlake, OH (US)

( * ) Notice: Subject to any disclaimer, the term of this patent is extended or adjusted under 35 U.S.C. 154(b) by 268 days.

(21) Appl. No.: 09/703,149

(22) Filed: Oct. 31, 2000

(51) Int. Cl.[7] ..... B05C 5/02

(52) U.S. Cl. ..... 118/696; 118/629; 118/308; 118/312; 118/326

(58) Field of Search ..... 118/696, 629, 118/308, 312, 326; 427/180, 421; 239/67, 69, 99; 700/123, 124

(56) References Cited

U.S. PATENT DOCUMENTS

| | | | | |
|---|---|---|---|---|
| 4,722,625 A | * | 2/1988 | O 'Brien | 200/520 |
| 5,167,714 A | | 12/1992 | Gimben et al. | 118/688 |
| 5,218,305 A | * | 6/1993 | Lunzer | 239/690 |
| 5,381,962 A | * | 1/1995 | Teague | 239/525 |
| 5,482,556 A | | 1/1996 | Shutic et al. | 118/621 |
| 5,566,042 A | | 10/1996 | Perkins et al. | 361/228 |
| 5,660,334 A | * | 8/1997 | Trusty et al. | 137/412 |
| 5,938,216 A | | 8/1999 | Rehman et al. | 239/707 |
| 6,021,799 A | | 2/2000 | Price | 137/102 |

FOREIGN PATENT DOCUMENTS

WO WO0007741 * 2/2000

* cited by examiner

*Primary Examiner*—Laura Edwards
(74) *Attorney, Agent, or Firm*—Calfee, Halter & Griswold, LLP

(57) ABSTRACT

A remote control device that provides a wireless connection between the operator and a control console of a material coating spraying system, thereby allowing the operator to select, change, modify and otherwise control a variety of parameters and functions of the spraying operation. The remote capability permits an operator to be stationed at, in or near the spray booth so as to be able to observe the actual spraying operation and transmit instructions to the control console. In one embodiment, a powder spray system includes a spray gun having a pressurized air inlet and a powder inlet, a powder spray booth, a powder supply for feeding powder to the gun, a control console separately located with respect to the booth; the console being operable to control a spraying operation; and a hand-held remote control device for wireless operation of the control console by an operator positioned a distance from the console.

20 Claims, 8 Drawing Sheets

REMOTE CONTROL DEVICE FOR PAINTING SYSTEM

TECHNICAL FIELD OF THE INVENTION

The present invention relates to powder and liquid coating material spray apparatus. More particularly, the invention relates to augmenting a control system for a spray apparatus with a hand-held remote control device.

BACKGROUND OF THE INVENTION

Powder and liquid coating materials are commonly applied to target objects by spraying the material in a selectable spray pattern. A typical powder spray apparatus includes one or more spray guns, a powder spray booth, a powder supply, a control console, and often a powder overspray collection and/or reclamation system. Such apparatus are well known and described in the following exemplary U.S. Pat. Nos. 5,167,714; 5,482,556; 5,566,042; and 6,021,799, the entire disclosures of which are fully incorporated herein by reference.

The powder spray gun may be electrostatic or non-electrostatic. In an electrostatic spray gun, a high voltage electrode is used to apply an electrostatic charge to the powder to improve the transfer ratio of powder adhering to the target object (transfer ratio being the ratio of powder that adheres to the target to the total amount of powder sprayed at the target.) Powder spray guns typically include a triggering mechanism that is used to control the flow of powder through the gun. Spray guns may be manually operated or automatic.

A spraying operation is performed in a powder spray booth. The primary objective of using the booth is for powder overspray containment. Some powder booths are equipped or may be equipped with powder collection and recovery systems that collect powder overspray and either transfer the collected powder to a holding container or return the collected powder to the powder supply for continued use.

The spray gun(s) are supported in the spray booth either on a stationary platform or on a movable platform. The movable platform may include a gun mover that not only can set and change the horizontal position of the gun spray nozzle relative to the target, but may also include the function of vertical movement of the gun(s).

Each spray gun receives a flow of powder coating material from a powder supply or feed center. Powder for a spraying operation is held in a hopper or other suitable container. Powder is drawn from the hopper by operation of a pneumatic powder feed pump. The powder pump typically operates from one or more pressurized air supplies, and feeds powder to the gun via a powder feed hose or tube.

The powder supply in the hopper is also typically fluidized by a flow of air through the powder, either through the floor of the hopper or a supply of air that fluidizes the upper portion of the powder. Virgin powder may be loaded into the hopper either manually or by operation of an automated powder transfer apparatus that transfers powder from a powder drum or other powder supply container to the hopper. In an automated powder transfer apparatus, sensors may be used to detect the powder level in the hopper and also to monitor the transfer operation.

It is thus evident that in a conventional powder spraying system, there is a large number of functions and operations that are controlled, either manually, automatically or a combination of the two. Overall control is usually carried out via a control console that is located a distance from the spray booth. The control console may include any number of mechanisms for controlling operation of a powder spray operation, including controlling air flow for the pumps, electrical energy for electrostatic guns, triggering the guns at the appropriate time intervals, gun position and powder feed. Any number of valves, regulators, switches, control circuits and so forth may be used to execute these functions. However, in known systems, such functions are implemented by an operator having to be stationed within arm's reach of the control console, rather than at the spray booth or other distant location. This remote location of the control console makes it difficult for an operator to observe the spraying operation and to make adjustments if required. If the operator is observing a powder spraying operation at the booth, the operator must actually walk over to the control console to effect the desired change. The operator must then return to the booth and determine if the changes had the desired effect.

It is desired, therefore, to provide new methods and apparatus for powder spraying systems that permit remote operation and control of the various functions and parameters of a spraying operation.

SUMMARY OF THE INVENTION

The invention contemplates a remote control device that is preferably but not necessarily a hand-held device. The remote control device provides a wireless connection between the operator and the control console, thereby allowing the operator to select, change, modify and otherwise control a variety of parameters and functions of the spraying operation. The remote capability permits an operator to be stationed at, in or near the spray booth so as to be able to observe the actual spraying operation and transmit instructions to the control console.

The invention is realized in one embodiment in the form of a powder spray system that includes at least one spray gun having a pressurized air inlet and a powder inlet, a powder spray booth in which a part is sprayed with powder from the gun, a powder supply for feeding powder to the gun, a control console separately located with respect to the booth; the console being operable to control a spraying operation; and a hand-held remote control device to control wireless operation of the control console by an operator positioned a distance from the console.

The present invention further contemplates the methods embodied in the use of such a remote control apparatus in combination with a powder spraying apparatus, and in accordance with another aspect of the invention, a method for controlling a powder spray system of the type having a spray gun, a spray booth, a powder supply and a control console, the method including the steps of selecting at least one parameter of a spraying operation; and controlling the selected parameter by sending an electronic instruction to the control console using a wireless transmitter from a remote location.

These and other aspects and advantages of the present invention will be apparent to those skilled in the art from the following description of the preferred embodiments in view of the accompanying drawings.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein.

DETAILED DESCRIPTION OF THE PREFERRED EMBODIMENTS

Figure 1:
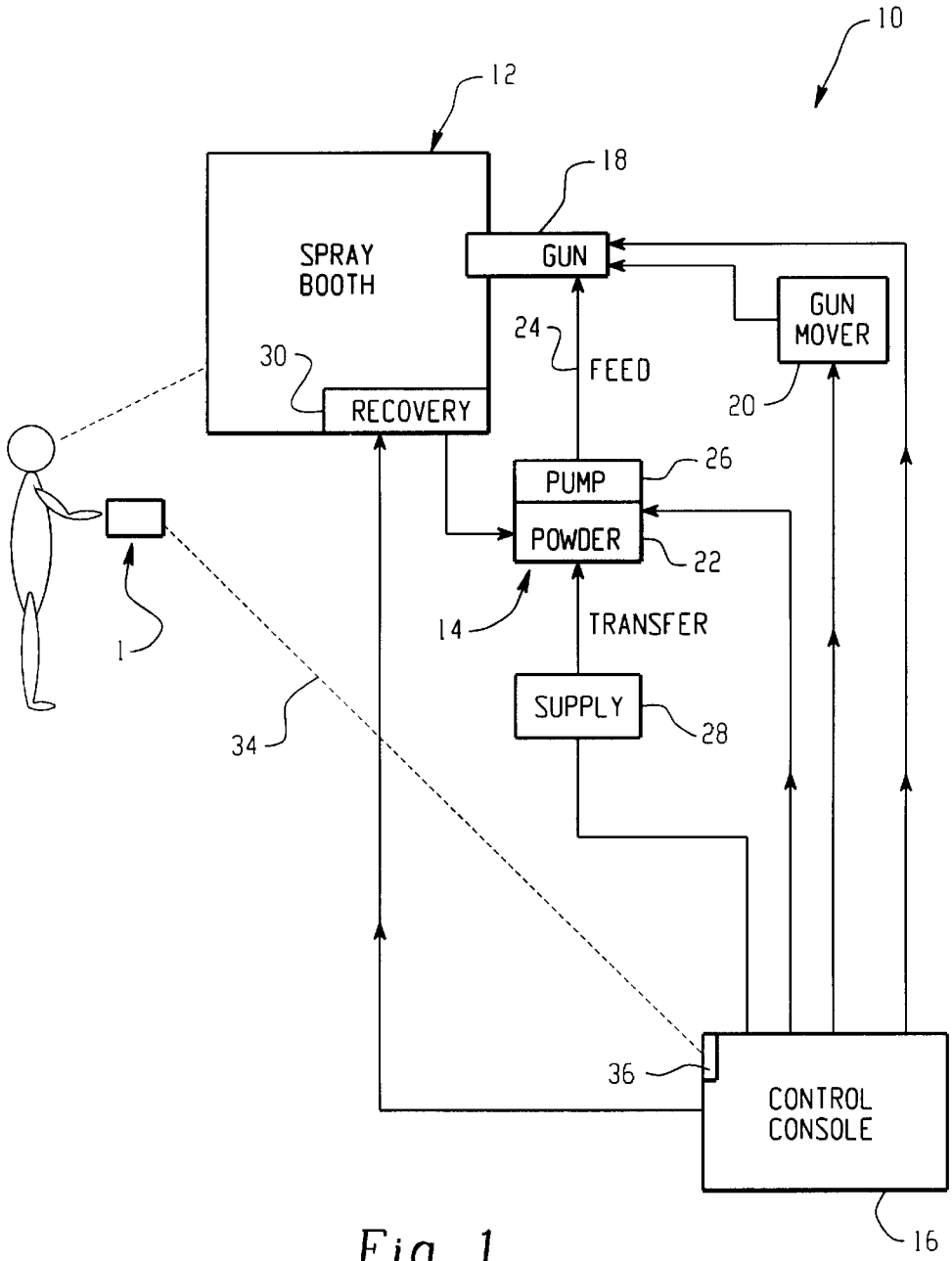
FIG. 1 is a simplified schematic representation of a typical powder spraying system and utilizing the present invention.

With reference to FIG. 1, the present invention is illustrated in use in a typical powder spraying apparatus 10 of the type that includes a powder spray booth 12 in which an object (not shown) is to be sprayed with a powder coating material 14. The application of powder to the object is generally referred to herein as a powder spraying operation, however, there may be any number of control functions, steps and parameters that are controlled and executed before, during and after powder is actually sprayed onto the target. Therefore, as used herein, the terminology of controlling a spraying operation should be construed in it broadest sense to include one or more of selecting, executing, controlling, adjusting, changing or modifying one or more aspects of a spraying operation. Thus it is contemplated, for example, that the invention may be used for controlling any one or more of a wide variety of parameters and functions of a spraying operation. These may include, but are not limited to, gun triggering control, powder feed control, powder supply control and gun position control, either as part of a manual operation, an automatic operation or a combination of the two. These features are described herein in connection with an exemplary description of the present invention but such description should not be construed in a limiting sense. The invention may find application in any powder spraying system in which it is desired to control one or more aspects of the spraying operation. Moreover, while the described embodiments herein are presented in the context of a powder spraying apparatus, those skilled in the art will readily appreciate that the present invention may be used in a liquid spraying system. Furthermore, the invention contemplates in the exemplary embodiments the capability to modify or program a remote device to adapt its control features to a specific application or even a single spraying operation. The various control functions are carried out through various devices associated with a control console 16.

The apparatus 10 further typically includes one or more spray guns 18 that are either fully or partially positioned within the spray booth 12. The guns may individually or collectively be manually triggered or automatic, and furthermore may be electrostatic or non-electrostatic in operation. The guns 18 may individually or collectively be mounted on a stationary support or mounted on a gun mover 20 as is known. Each gun 18 (for clarity only one is shown in FIG. 1) receives a powder feed from a powder hopper 22 by way of a powder feed hose 24. A pneumatic pump 26 draws the powder 14 from the hopper 22 and feeds the powder to the gun 18 via the feed hose 24. A powder supply 28, for example a powder drum, holds a fresh supply of powder that can be manually or automatically transferred to the hopper 22. The powder booth 12 may include a powder collection and recovery system 30 that collects powder overspray and either transfers it to a container or recycles the powder back to the hopper 22 as illustrated in FIG. 1.

In the apparatus of FIG. 1, the control console 16 is typically used as a central control location for the operator to make adjustments, set parameters and in general to control a spraying operation. The console 16 may include a programmable controller or other electronic logic circuit, and a variety of devices and interfaces for controlling operation of the guns 18, the gun mover 20, the powder pumps 26 and supply 28, and the recovery system 30. The specific design of the console 16 will be determined by the actual spraying system 10 design, and thus may include all or fewer than the illustrated features, or additional features. Again, specific details of a suitable control console and system are provided in the referenced patents and are otherwise well known to those skilled in the art.

Those skilled in the art will readily appreciate that the schematic of FIG. 1 is greatly simplified and is used solely for the purpose of providing an example of one of any number of powder spraying systems and apparatus that the present invention will find utility in combination. More or fewer components of the system 10 may be used with the present invention. Details of the individual components of FIG. 1 are provided in the above-referenced patents, among others.

The present invention contemplates the use of a remote control device 1 to augment the control functions, parameters and other features of the control console 16 used in the spraying apparatus 10. As illustrated in FIG. 1, the remote control device 1 is preferably but not necessarily realized in the form of a hand-held remote control, similar in size and weight to a television remote control. In accordance with one aspect of the invention, the remote control device 1 provides a wireless link between the operator and the control console 16, as represented in FIG. 1 with the dashed line 34. The wireless link permits the operator to send instructions to the control console 16 while being stationed at, in or near the powder spray booth 12 or other remote location relative to the console 16. In this manner, the operator can observe a spraying operation and send instructions to the control console 16 to change one or more parameters or functions, and at the same time observe the effects at the booth 12. The control console 16, for example, may be remotely located at a distance from the spray booth 12, even as far as 10 or 20 feet just to give an example. The actual distances will vary at each site and will only be limited by the effective range of the wireless transmission device 1. As a general aspect of the invention, however, "remote distance" or "remote location" means any distance or location beyond arm's length and less than the maximum range of the selected remote transmitter device 1.

In accordance with another aspect of the invention, the remote control device includes an encoder that converts one or more pushbutton commands into an electronic signal that is converted to a transmitted infrared (IR) signal. The IR signal is detected at a receiver 36 that detects the IR signal and decodes or converts it to an electronic instruction that is then processed by appropriate electronics in the control console 16. In an alternative embodiment, the wireless link may be carried out using a radio frequency (RF) transmitter and receiver rather than IR, or any other suitable wireless transmission. In yet another alternative embodiment, the remote control device 1 is realized in the form of a programmable device such as a PDA (personal digital assistant) that can also communicate with the control console 16 via a wireless link such as IR transmission. The PDA typically will be a software based device that may include other functionality not necessarily related to operation of the powder spraying apparatus. In this context then, the PDA version is considered to be a non-dedicated remote control 1 because the device might be used for other features such as e-mail, calendars and so on as is typical in a conventional PDA device such as the PALM PILOT™ series of PDA's. In the case of a pushbutton remote control device, such a device is considered herein to be a dedicated device in that the pushbuttons correspond to specific functions executed by the control console 16.

In accordance with still a further aspect of the invention, the control console 16 may include a visually perceptible display such as an LED bank or LCD display that can be visually accessed by the operator from the operator's remote location such as at the powder spray booth 12. Still further, the spray booth 12 and/or the gun mover 20, for example, may include separate receivers to detect the wireless signals intended for those specific control functions. This is particularly useful for modular installations in which the control console 16 may not include a connection to these individual subsystems. Therefore, the present invention may be used to provide wireless communication between the operator and any particular subsystem of the spraying apparatus 10 depending on the particular requirements of the system 10.

Figure 2:
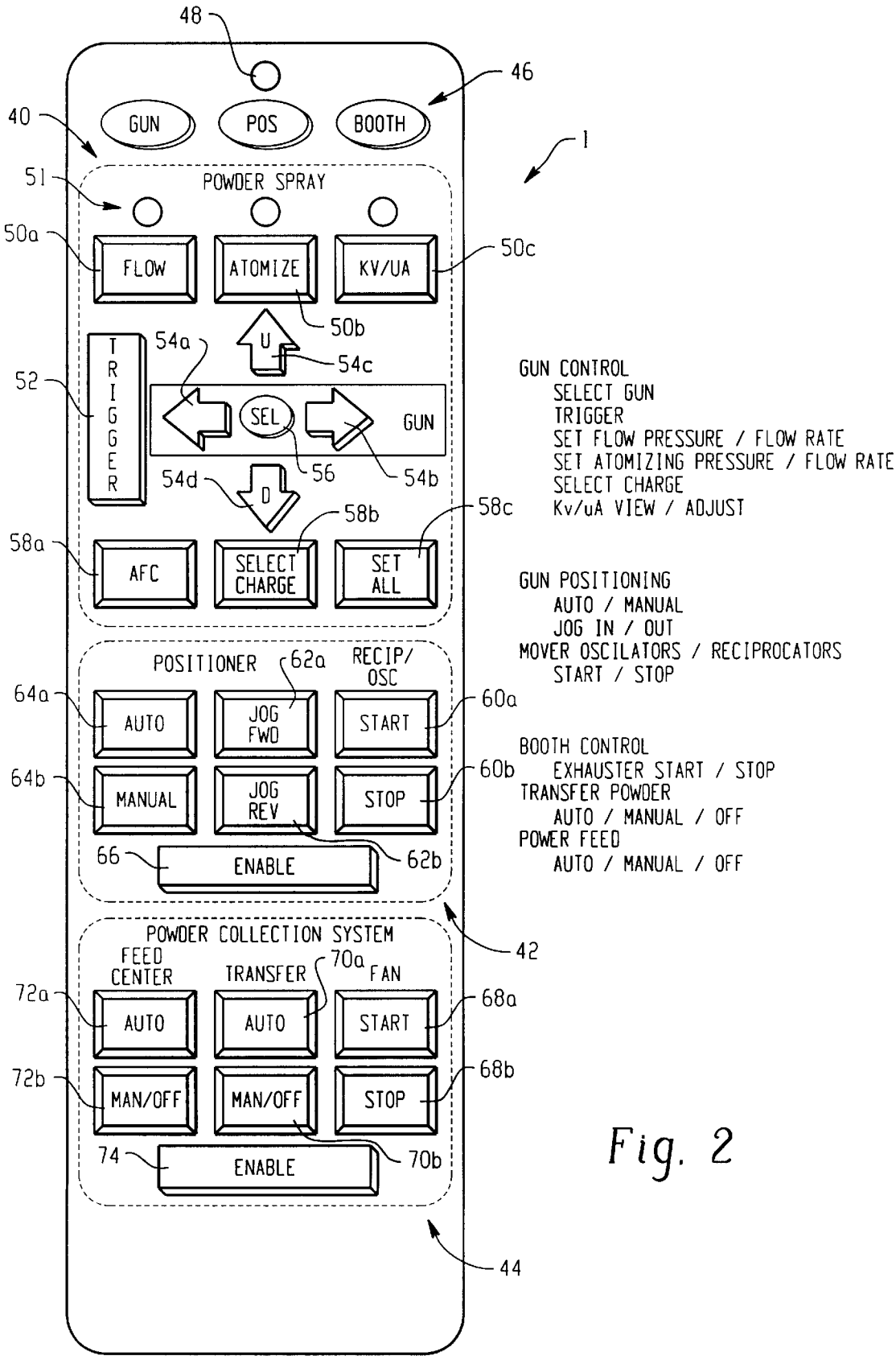
FIG. 2 is a plan view of a remote control device in accordance with the invention.

With reference then to FIG. 2, an exemplary first embodiment of a remote control device 1 is illustrated. In this embodiment, the remote pushbuttons or keys are organized into three functional blocks 40, 42 and 44 corresponding to gun functions, gun position or mover functions and spray booth functions respectively. A row of subsystem or function selection keys 46 permit the operator to select which functional block will be active, thus there is a gun key 46*a*, a gun position key 46*b* and a spray booth key 46*c*. When one of these keys is activated, the remote 1 will operate to transmit instructions for the keys in the corresponding functional block 40, 42 and 44. A light 48 may be used to confirm that the instructions were sent to the subsystem or control console receiver 36. It will be readily appreciated that the specific arrangement and organization of the functional keys is a matter of design choice, as is the selection of which functions will be controllable via operation of the remote control 1.

The upper functional block 40 in this example relates to control of functions and parameters of the spray guns 18. Thus a series of gun function keys 50*a*, 50*b* and 50*c* and associated lights 51 are used to select whether the operator wishes to send instructions regarding the flow air pressure and flow rate to the gun, atomizing air pressure and flow rate to the gun, or the operating voltage or current for electrostatic guns respectively. A manual trigger key 52 is provided to allow the operator to trigger individual guns or all the guns at one time. A series of detail or parameter select keys are provided including gun selection keys 54*a* and 54*b*, and "increase" and "decrease" keys 54*c* and 54*d*. A central select key 56 is provided to allow the operator to set the selected parameter as selected via operation of the selection keys 54*a–d*.

Additional function select keys are provided as required. In this case, an AFC key 58*a* is provided to allow the operator to select whether the guns will operate in a voltage mode or current feedback mode. A select charge key 58*b* is used to select the electrode voltage of the gun (by further operation of the parameter select keys 54*c, d*). Finally, a set all key 58*c* is provided that allows the operator to set the same parameters and functions for all the guns at the same time.

In the gun position block 42, start and stop keys 60*a* and 60*b* are used to turn the reciprocator or oscillator on and off, thus controlling vertical movement of the guns 18. Jog keys 62*a* and 62*b* are used to control incremental movement and position changes of the guns horizontally with respect to the target. Auto and manual keys 64*a* and 64*b* are provided to allow the operator to select whether the gun position mechanism will operate in an automatic mode or manual. As a safety measure, an enable key 66 is provided that must first be activated before the operator can cause gun movements via the function keys 60, 62. In this manner the guns will not be moved by accidental activation of the function keys. The control console 16 can be programmed to only permit gun movement if the enable key 66 is activated before the function keys and within a specified time period.

In the booth control block 44, start and stop keys 68*a* and 68*b* are provided to operate the exhaust fan in the spray booth 18. Automatic and manual function keys 70*a* and 70*b* are provided to select whether powder will be automatically or manually transferred to the hopper. Similar keys 72*a* and 72*b* are provided for selecting the feed mode of powder to the guns 18. Another enable key 74 is provided as a safety feature to prevent inadvertent operation of the powder feed, transfer and fan functions.

Figure 3:
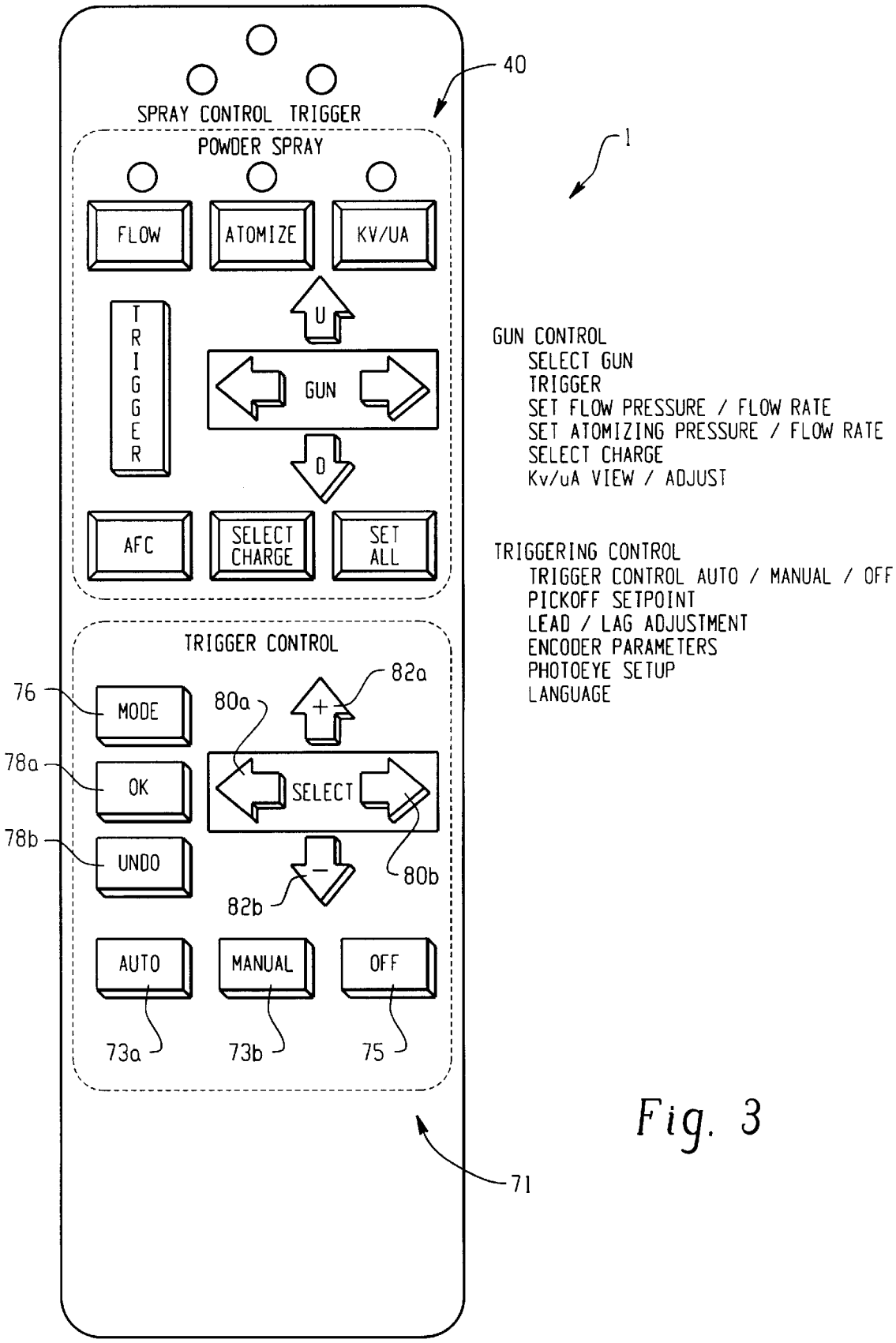
FIG. 3 illustrates an alternative embodiment of the invention.

With reference to FIG. 3, an alternative embodiment of the remote control device 1 is illustrated. The only difference in the overall operation and system is the type of functions and parameters that may be selected via operation of the remote 1. In this embodiment, the keys are divided into two functional blocks 40 and 71. The upper functional block 40 is identical in function and design to the corresponding block 40 in FIG. 1 as previously described herein. The second functional block 71 includes functions and parameters that relate to spraying systems that automatically trigger the guns 18 based on sensors that detect the part size, position and so forth. Accordingly, the remote 1 may be used to select automatic or manual mode by appropriate activation of the auto and manual keys 73*a* and 73*b*. An off key 75 is provided to disable the trigger function from the remote location, thus allowing an operator to interrupt, for example, an automatic spraying operation without having to physically go to the control console 16.

Various automatic triggering parameters may be set using the mode key 76 along with the OK and undo keys 78*a*, 78*b*. The mode key 76 allows the operator to scroll through a series of triggering operations and parameters by use of the select keys 80*a, b* and the scroll keys 82*a, b*. For example, parameters that may be selected include among others pickoff setpoints for when the guns are triggered, lead lag adjustments, position encoder parameters, language and photoeye setup. All of these functions are a matter of design criteria for the particular spraying apparatus 10, and may include additional or fewer functions as required.

Figure 4B:
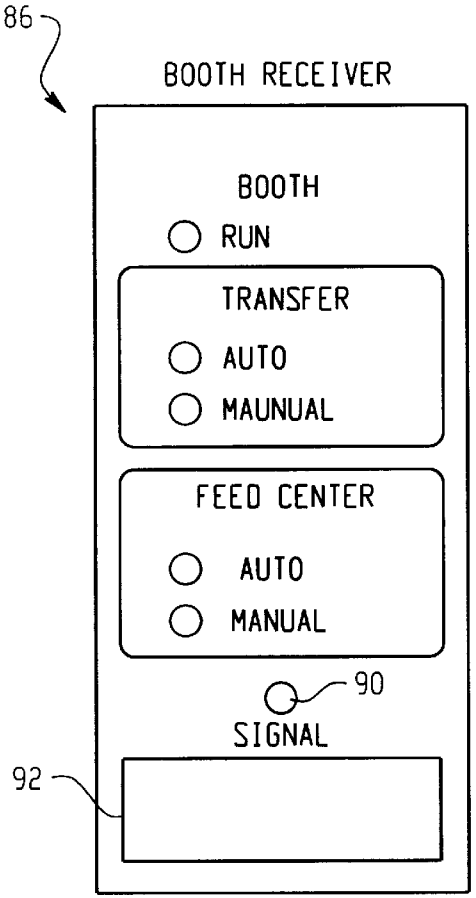
FIGS. 4A, 4B and 4C illustrate exemplary receiver devices used with the invention.
Figure 4A:
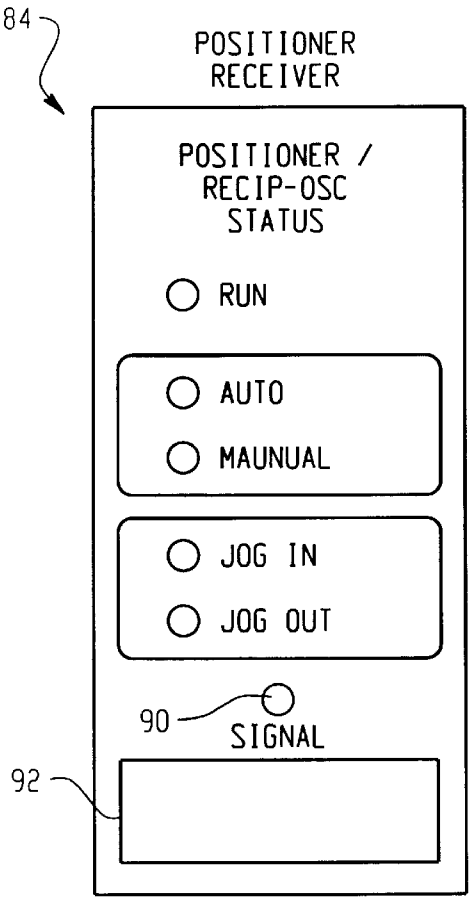
Figure 4C:
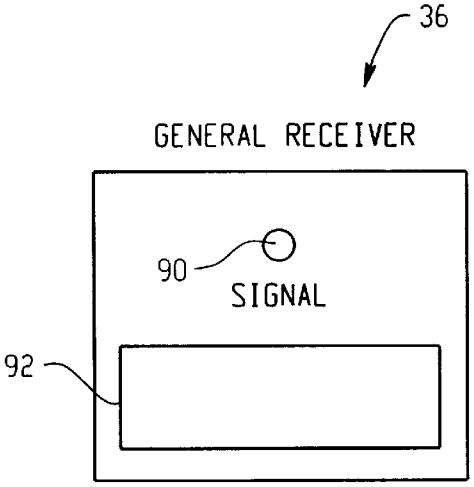

FIGS. 4A, 4B and 4C illustrate examples of receivers that may be used with the remote control device 1. In FIG. 1, the main receiver 36 is installed in or on the control console 16. As noted hereinabove, additional or alternative receivers may be used on specific subsystems of the apparatus 10, for example the gun mover 20 or the spray booth 12. FIG. 4A illustrates an exemplary positioner or gun mover receiver 84. All the receivers include a light 90 that indicates a signal is being received, as well as a detector array 92 that detects the IR or radio frequency signal transmitted by the remote control device 1. The positioner receiver of FIG. 4A also includes lights for indicating the operating modes of the gun mover 20, including whether the mover 20 is in automatic or manual mode, or whether the mover is jogging in or out, and a run light to indicate that the mover 20 has been turned on. It is intended that these lights be visually perceptible to the operator from convenient viewing angles. The booth receiver 86 in FIG. 4B includes lights for indicating the operating modes for the powder transfer and feed functions, as well as whether the booth is running. The main receiver 36 only contains the signal light 90 because a separate visual display will typically be used with the control console 16.

Figure 5A:
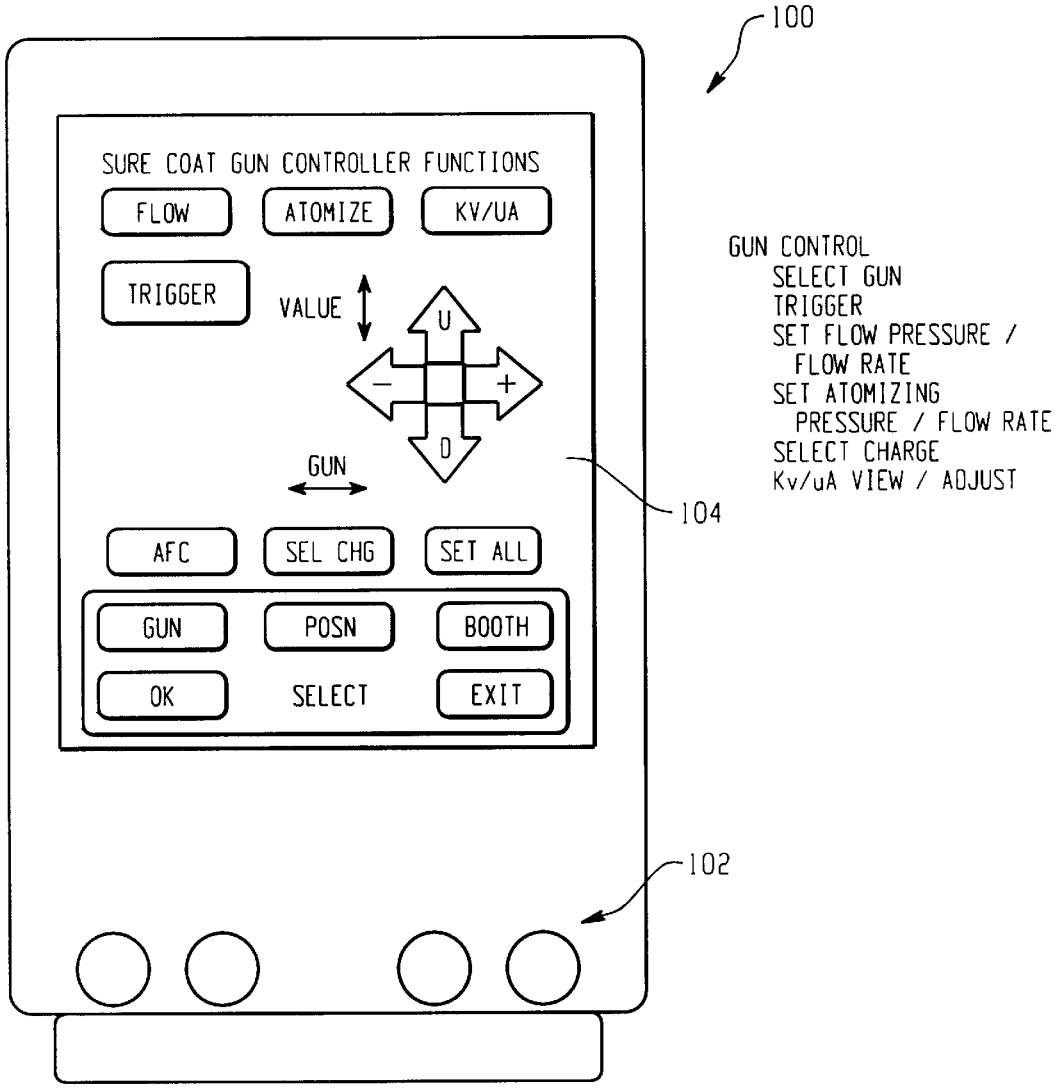
FIGS. 5A, 5B and 5C illustrate a PDA version of the invention.
Figure 5B:
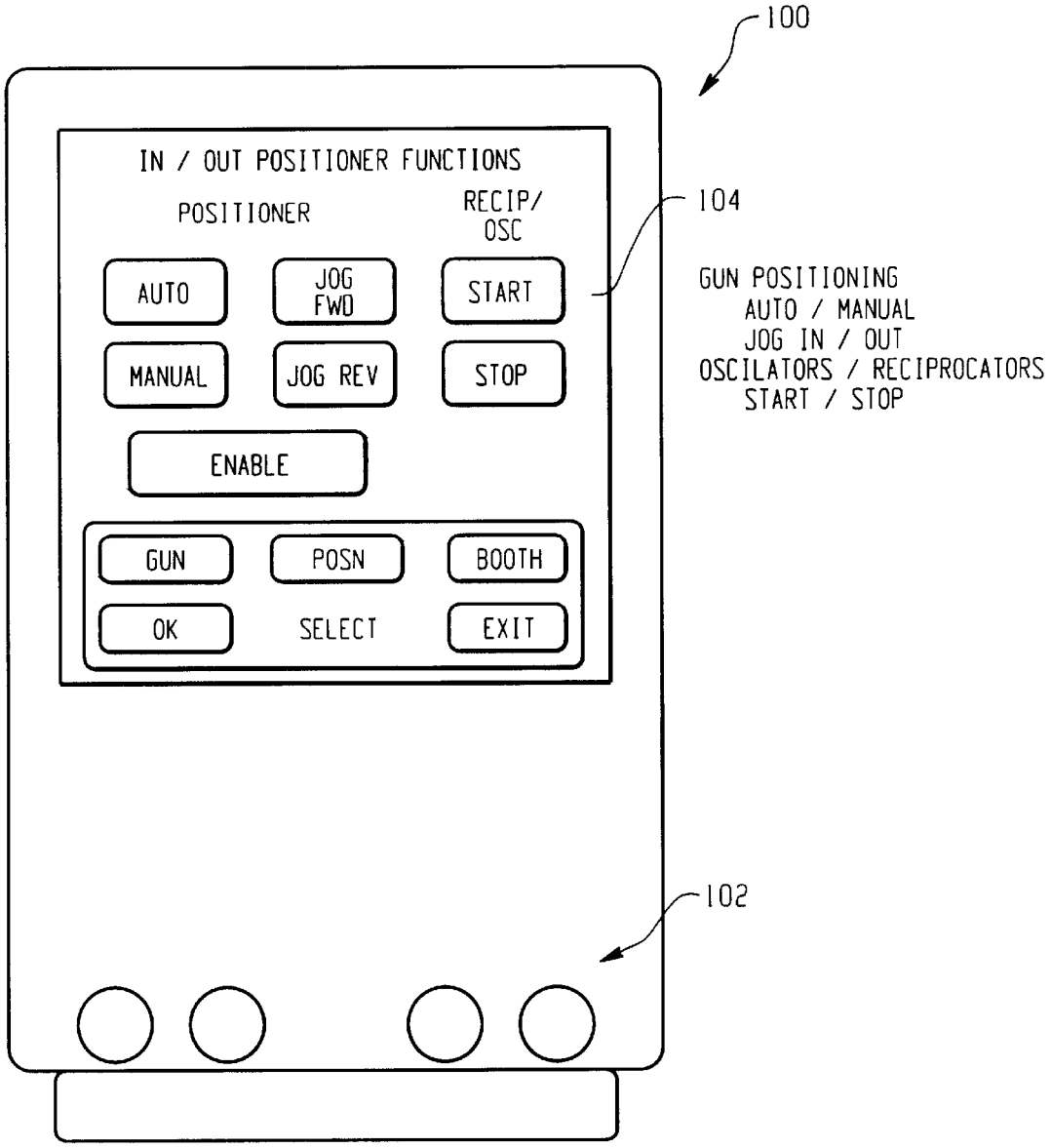
Figure 5C:
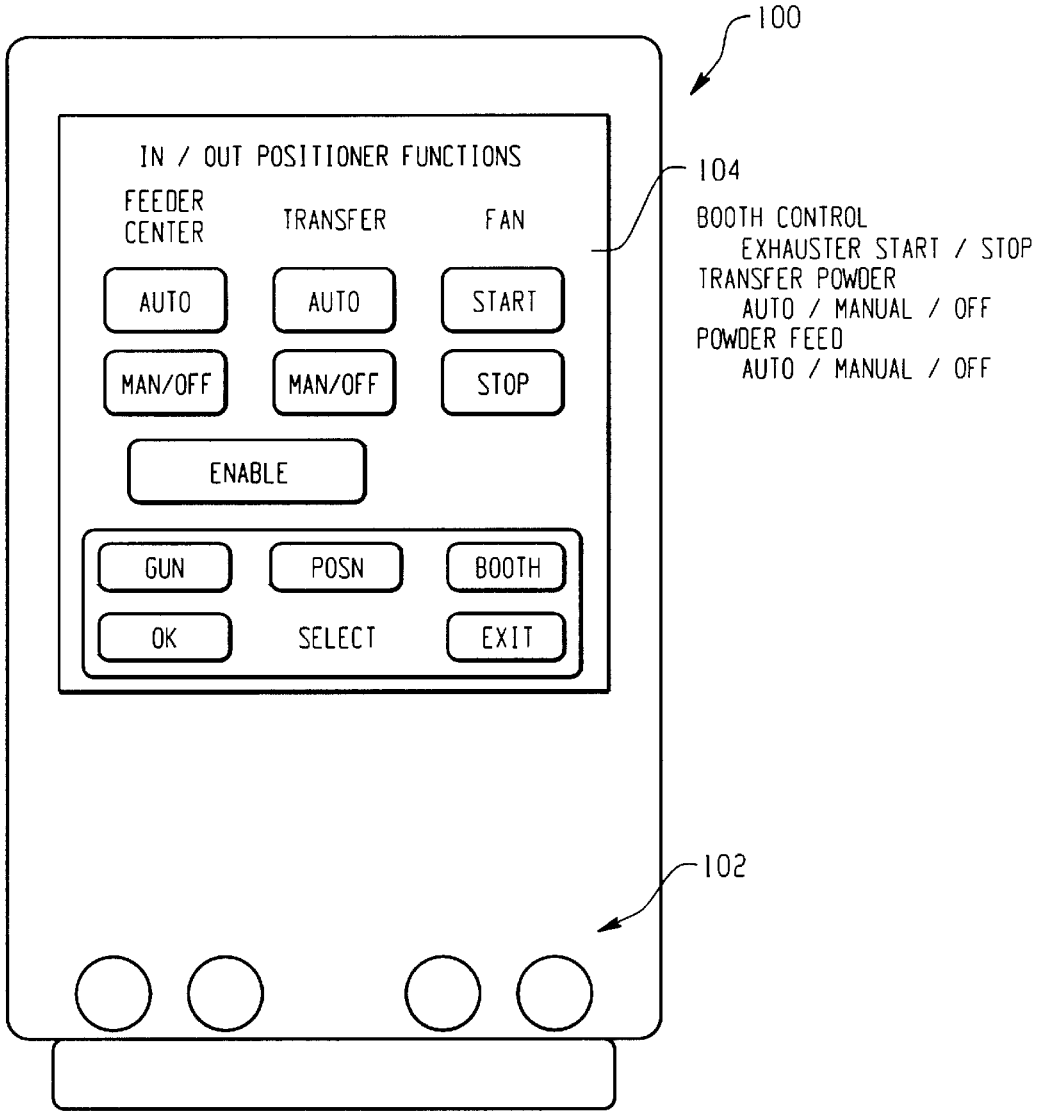

FIGS. 5A, 5B and 5C illustrate a PDA 100 version of the invention. The functionality carried out using the PDA 100 may be substantially the same as for the dedicated remote device. The various figures illustrate exemplary menu selections. Note that the PDA 100 typically includes function keys 102 for additional features such as a calculator, to do lists, calendar, and other program selections, therefore this device is considered herein to be a non-dedicated remote control device. As is known, the PDA 100 may include other functions and programs that are selected by the user by activating menu choices on the screen 104. The PDA version further differs from the dedicated remote device 1 in that it is primarily software driven as opposed to key activated. The operator makes the parameter and function selections via a keypad or touch screen as per standard operation of the PDA, then the program and/or data is transferred to the control console by wireless transmission.

Figure 6A:
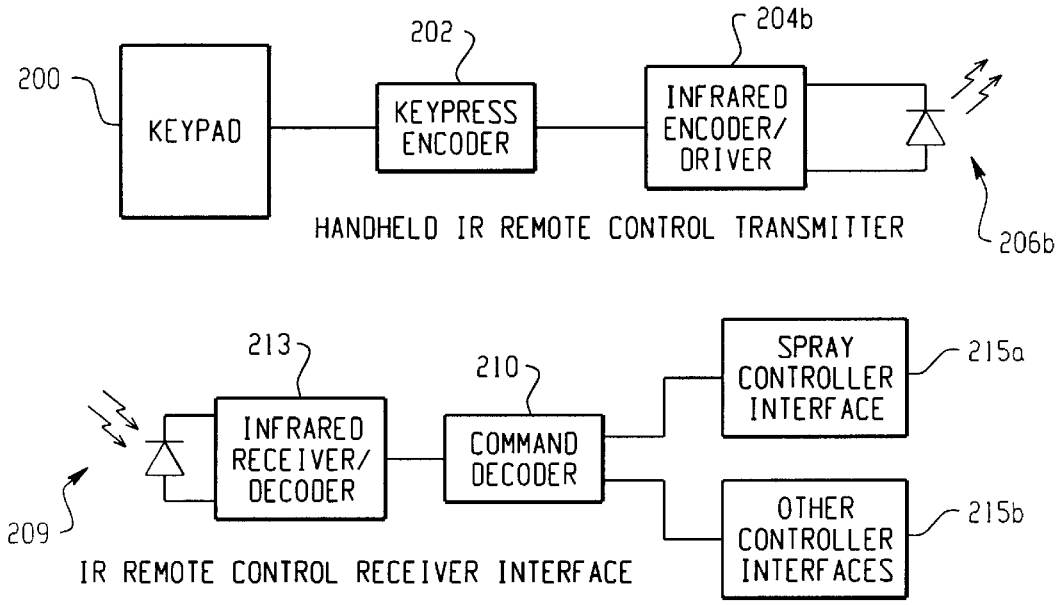
FIGS. 6A and 6B are schematic block diagrams of the remote transmission function.
Figure 6B:
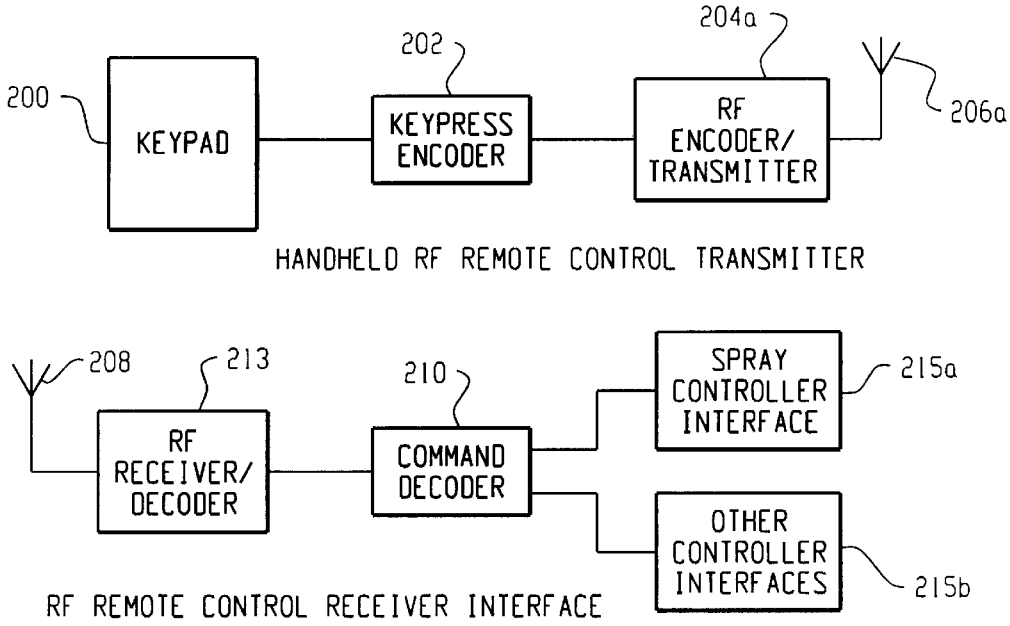

With reference to FIGS. 6A and 6B, an operator makes selections by actuation of the remote control device 1 via the keypad 200. A keypad encoder 202 converts key selections to an appropriate code that is further encoded and transmitted by an encoder/transmitter 204*a* as an RF signal via an RF antenna 206*a,* or transmitted by an encoder/driver circuit 204*b* as an IR signal via an IR transmitter 206*b*. The RF signal is transmitted via the antenna 206*a* to the receiver antenna 208, and the IR signal is detected by an infrared receiver 209. The IR or RF signal is decoded by a second decoder 213 into the encoded key signal. A third decoder 210 converts the key command to appropriate instructions or control signals to the selected subsystem, such as the spray controller or other controllers 215*a, b*.

The specific designs of the encoders and decoders may be conventional or specific to a particular application. For example, the dedicated remote device 1 may use standard wireless transmission protocols and circuits commonly used with television remote control devices. The PDA device typically will use IrDA protocols.

In accordance with additional aspects of the invention, the RF version may utilize a single receiver that decodes and routes control signals and messages to all units and subsystems in the apparatus 10. The infrared version may utilize multiple receivers due to line of sight operation of the transmitters.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A powder spray system comprising:

at least one spray gun having a pressurized air inlet and a powder inlet;

a powder spray booth in which a part is sprayed with powder from said gun;

a powder supply for feeding powder to said gun;

a control console separately located with respect to said booth; said console being operable to control a spraying operation; and a hand-held remote control device to control wireless operation of said control console by an operator positioned a distance from said console.

2. The system of claim 1 wherein said remote control device is operable to transmit instructions from said device to said console to control at least one of the following spraying operation functions: spray gun operation, spray gun position, booth operation.

3. The system of claim 2 wherein said remote control device is operable to transmit instructions to said console at least two of said spraying operation functions.

4. The system of claim 2 wherein said remote control device is operable to transmit instructions to said console to control all three of said spraying operation functions.

5. The system of claim 2 wherein said remote control device is operable to control gun selection, gun triggering, electrostatic parameters and pressurized air parameters.

6. The system of claim 2 wherein said remote control device is operable to adjust gun position within said booth.

7. The system of claim 2 wherein said remote control device is operable to control powder feed from said powder supply to said gun and powder transfer to said powder supply from a powder source.

8. The system of claim 1 wherein an operator can observe a spraying operation at a position proximate to said booth and transmit instructions to said console via said remote control device to adjust one or more parameters of said spraying operations.

9. The system of claim 1 wherein said remote control device comprises an infrared encode and transmitter and said console comprises an infrared receiver and decoder.

10. The system of claim 9 wherein said remote control device comprises a plurality of pushbuttons for an operator to select and adjust spraying operation parameters.

11. The system of claim 9 wherein said console comprises a display that can be visually perceived by an operator proximate said booth, said display providing visual feedback to the operator of spraying operation parameters and adjustments.

12. The system of claim 1 wherein said remote control device comprises an RF encoder and transmitter and said console comprises an RF receiver and decoder.

13. The system of claim 1 wherein said remote control device is operable to transmit an instruction to said console to select automatic and manual triggering modes for said gun.

14. The system of claim 1 wherein said remote control device is operable to transmit an instruction to said console to select automatic and manual powder transfer modes.

15. The system of claim 1 wherein said remote control device comprises a PDA device.

16. The system of claim 15 wherein said PDA comprises a selectable program for controlling a spraying operation.

17. The system of claim 16 wherein said PDA is a non-dedicated device having additional programs unrelated to controlling a spraying operation.

18. The system of claim 16 wherein said PDA program comprises a menu driven interface for an operator to select and modify a plurality of spraying operation parameters, said PDA thereafter being operable to transmit instructions to said console based on said operator selections.

19. The system of claim 18 wherein said console comprises a local controller that receives and executes said instructions.

20. The system of claim 1 wherein said remote control device is a dedicated control device.

* * * * *